US008366844B2

(12) United States Patent
Sun

(10) Patent No.: US 8,366,844 B2
(45) Date of Patent: Feb. 5, 2013

(54) METHOD OF MAKING HOT ROLLED DUAL PHASE STEEL SHEET

(75) Inventor: Weiping Sun, Canton, MI (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 13/246,418

(22) Filed: Sep. 27, 2011

(65) Prior Publication Data

US 2012/0018059 A1 Jan. 26, 2012

Related U.S. Application Data

(60) Division of application No. 12/177,844, filed on Jul. 22, 2008, which is a continuation-in-part of application No. 10/997,480, filed on Nov. 24, 2004, now Pat. No. 7,442,268.

(51) Int. Cl.
*C21D 8/02* (2006.01)

(52) U.S. Cl. ..... 148/602; 148/533; 148/648; 148/654

(58) Field of Classification Search ..... 148/602, 148/533, 648, 654
See application file for complete search history.

(56) References Cited

U.S. PATENT DOCUMENTS

| | | | |
|---|---|---|---|
| 3,837,894 | A | 9/1974 | Tucker |
| 4,072,543 | A | 2/1978 | Coldren et al. |
| 4,361,448 | A | 11/1982 | Sippola |
| 4,376,661 | A | 3/1983 | Takechi et al. |
| 4,394,186 | A | 7/1983 | Furukawa |
| 4,398,970 | A | 8/1983 | Marder |
| 4,436,561 | A | 3/1984 | Takahashi et al. |
| 4,437,902 | A | 3/1984 | Pickens et al. |
| 4,609,410 | A | 9/1986 | Hu |
| 4,615,749 | A | 10/1986 | Satoh et al. |
| 4,708,748 | A | 11/1987 | Satoh et al. |
| 4,770,719 | A | 9/1988 | Hashiguchi et al. |
| 4,854,976 | A | 8/1989 | Era et al. |
| 5,312,493 | A | 5/1994 | Masui et al. |
| 5,328,528 | A | 7/1994 | Chen |
| 5,454,887 | A | 10/1995 | Fukui |
| 5,470,403 | A | 11/1995 | Yoshinaga et al. |
| 6,143,100 | A | 11/2000 | Sun |
| 6,210,496 | B1 | 4/2001 | Takagi et al. |
| 6,221,179 | B1 | 4/2001 | Yasuhara et al. |

(Continued)

FOREIGN PATENT DOCUMENTS

| | | | |
|---|---|---|---|
| AU | 2005200300 | A1 | 1/2005 |
| EP | 0945522 | A1 | 9/1999 |

(Continued)

OTHER PUBLICATIONS

Thelning, Karl-Erik, Head of Research and Development Smedjebacken-Boxholm Stal AB, Sweden, Steel and Heat Treatment, Second Edition; Butterworths, printed in Great Britain by Mackagys of Chatham Ltd., Kent; pp. 436-437, 1984.

(Continued)

*Primary Examiner* — Deborah Yee
(74) *Attorney, Agent, or Firm* — Moore & Van Allen PLLC

(57) ABSTRACT

A method of making hot rolled steel sheet having a dual phase microstructure with a martensite phase of less than 35% by volume and a ferrite phase of more than 50% by volume and a composition containing by percent weight: $0.01 \leqq C \leqq 0.2$; $0.3 \leqq Mn \leqq 3$; $0.2 \leqq Si \leqq 2$; $0.2 \leqq Cr+Ni \leqq 2$; $0.01 \leqq Al \leqq 0.10$; Mo less than about 0.2%, $0.0005 \leqq Ca \leqq 0.01$, with the balance iron and incidental ingredients. Hot rolled sheet for cold rolling, the silicon range may be from about 0.05% to about 2%, and the amount of molybdenum may be up to 0.5%. Also, the hot rolled steel sheet has a tensile strength of at least 500 megapascals, a hole expansion ratio more than about 50%, and a yield strength/tensile strength ratio less than 70%.

34 Claims, 4 Drawing Sheets

U.S. PATENT DOCUMENTS

| | | | |
|---|---|---|---|
| 6,312,536 | B1 | 11/2001 | Omiya |
| 6,423,426 | B1 | 7/2002 | Kobayashi et al. |
| 6,440,584 | B1 | 8/2002 | Nagataki et al. |
| 6,537,394 | B1 | 3/2003 | Osawa et al. |
| 6,641,931 | B2 | 11/2003 | Claessens et al. |
| 6,666,932 | B2 | 12/2003 | Funakawa et al. |
| 6,673,171 | B2 | 1/2004 | Hlady |
| 6,676,774 | B2 | 1/2004 | Matsuoka et al. |
| 6,702,904 | B2 | 3/2004 | Kami et al. |
| 6,706,419 | B2 | 3/2004 | Yoshinaga et al. |
| 6,709,535 | B2 | 3/2004 | Utsumi et al. |
| 6,726,782 | B2 | 4/2004 | Nakai et al. |
| 6,811,624 | B2 | 11/2004 | Hoydick |
| 6,814,819 | B2 | 11/2004 | Matsuoka et al. |
| 6,818,074 | B2 | 11/2004 | Matsuoka et al. |
| 6,869,691 | B2 | 3/2005 | Nagataki et al. |
| 6,982,012 | B2 | 1/2006 | Nomura et al. |
| 7,090,731 | B2 | 8/2006 | Kashima et al. |
| 7,118,809 | B2 | 10/2006 | Utsumi |
| 7,311,789 | B2 | 12/2007 | Hoydick |
| 7,381,478 | B2 | 6/2008 | Yokoi et al. |
| 7,396,420 | B2 | 7/2008 | Matsuoka et al. |
| 7,442,268 | B2 | 10/2008 | Sun |
| 7,527,700 | B2 | 5/2009 | Kariya et al. |
| 7,534,312 | B2 | 5/2009 | Yoshinaga et al. |
| 7,553,380 | B2 | 6/2009 | Ikeda et al. |
| 7,608,155 | B2 | 10/2009 | Sun |
| 2002/0096232 | A1 | 7/2002 | Nakai et al. |
| 2003/0041932 | A1 | 3/2003 | Tosaka et al. |
| 2003/0084966 | A1 | 5/2003 | Ikeda et al. |
| 2003/0129444 | A1 | 7/2003 | Matsuoka |
| 2004/0003774 | A1 | 1/2004 | Moore |
| 2004/0035500 | A1 | 2/2004 | Ikeda et al. |
| 2004/0047756 | A1 | 3/2004 | Rege et al. |
| 2004/0074573 | A1 | 4/2004 | Funakawa et al. |
| 2004/0118489 | A1 | 6/2004 | Sun |
| 2004/0238080 | A1 | 12/2004 | Vandeputte et al. |
| 2004/0238082 | A1 | 12/2004 | Hasegawa et al. |
| 2005/0016644 | A1 | 1/2005 | Matsuoka et al. |
| 2005/0019601 | A1 | 1/2005 | Matsuoka et al. |
| 2006/0144482 | A1 | 7/2006 | Moulin |
| 2006/0191612 | A1 | 8/2006 | Yoshida et al. |
| 2007/0003774 | A1 | 1/2007 | McDaniel |
| 2007/0144633 | A1 | 6/2007 | Kizu et al. |
| 2009/0071574 | A1 | 3/2009 | Sun |
| 2009/0071575 | A1 | 3/2009 | Sun |
| 2009/0242085 | A1 | 10/2009 | Ikeda et al. |

FOREIGN PATENT DOCUMENTS

| | | | |
|---|---|---|---|
| EP | 0969112 | A1 | 1/2000 |
| EP | 1191114 | A1 | 2/2001 |
| EP | 1291448 | A1 | 3/2003 |
| EP | 1338667 | A1 | 8/2003 |
| EP | 1431407 | A1 | 6/2004 |
| EP | 1666622 | A1 | 9/2004 |
| JP | 54033218 | | 3/1979 |
| JP | 55100934 | A | 8/1980 |
| JP | 56013437 | A | 2/1981 |
| JP | 58058264 | A | 4/1983 |
| JP | 61045788 | U | 3/1986 |
| JP | 61045892 | U | 3/1986 |
| JP | 08246097 | | 9/1996 |
| JP | 10251794 | | 9/1998 |
| JP | 2000239791 | A | 9/2000 |
| JP | 2000336455 | A | 12/2000 |
| JP | 2001089811 | A | 4/2001 |
| JP | 2001220648 | | 8/2001 |
| WO | 2004059026 | A2 | 7/2004 |

OTHER PUBLICATIONS

U.S. Steel—Automotive Center—Comparison of Mechanical Properties; http://www.usautomotive.com/auto/tech/mech_properties.htm, copyright 2005.

Gedeon, S.A., et al., Resistance Spot Welding Galvanized Steel: Part II. Mechanisms of Spot Weld Nugget Format in; Metallurgical Transactions B; vol. 17B, Dec. 1986, pp. 887-901; Manuscript submitted Aug. 15, 1985.

Malyshevskii, V.A., et al., Structural Steels; Effect of Alloying Elements and Structure on the Properties of Low-Carbon Heat-Treatable Steel; Translated from Metallovedenie I Termischeskaya Obrabotka Metallov, No. 9, pp. 5-9, Sep. 2001.

Herring, Daniel H., What Happens to Steel During Heat Treatment? Part One: Phase Transformations, Apr. 9, 2007; http://www.industrialheating.com/CDA/Articles/Column/BNP_GUID_9-5-2006_A_10000000000000083813.

The International Bureau of WIPO, International Preliminary Report on Patentability for International Application No. PCT/US2009/051461 dated Jan. 25, 2011.

The International Bureau of WIPO, International Search Report and Written Opinion of International Searching Authority for International Application No. PCT/US2009/051461 dated Mar. 8, 2010.

Mills, Kathleen, et al., Metals Handbook Ninth Edition, vol. 9, Metallography and Microstructures, Terms and Definitions, p. 11, American Society for Metals, Metals Park, Ohio, 1985.

European Patent Office, EP Standard Search Report dated Apr. 19, 2007.

(500x)

(1000x)

METHOD OF MAKING HOT ROLLED DUAL PHASE STEEL SHEET

RELATED APPLICATIONS

This application is a divisional application of U.S. patent application Ser. No. 12/177,844, filed Jul. 22, 2008, now allowed which is a continuation-in-part of U.S. patent application Ser. No. 10/997,480, filed Nov. 24, 2004, now U.S. Pat. No. 7,442,268 both of which are hereby incorporated by reference.

BACKGROUND AND SUMMARY

The present invention is directed to a dual phase structured (ferrite and martensite) steel sheet product and a method of producing the same.

Applications of high strength steel sheets to automotive parts, electric apparatus, building components and machineries are currently increasing. Among these high strength steels, dual phase steel, which possess microstructures of martensite islands embedded in a ferrite matrix, is attracting more and more attention due to such dual phase steel having a superior combination of the properties of high strength, excellent formability, continuous yielding, low yield strength/tensile strength ratio and/or high work hardening. Particularly with respect to automotive parts, martensite/ferrite dual phase steels, because of these properties, can improve vehicle crashworthiness and durability, and also can be made thin to help to reduce vehicle weight as well. Therefore, martensite/ferrite dual phase steels help to improve vehicle fuel efficiency and vehicle safety.

The previous research and developments in the field of dual phase steel sheets have resulted in several methods for producing dual phase steel sheets, many of which are discussed below.

U.S. Patent Application Publication No. 2003/0084966A1 to Ikeda et al. discloses a dual phase steel sheet having low yield ratio, and excellence in the balance for strength-elongation and bake hardening properties. The steel contains 0.01-0.20 mass % carbon, 0.5 or less mass % silicon, 0.5-3.0 mass % manganese, 0.06 or less mass % aluminum, 0.15 or less mass % phosphorus, and 0.02 or less mass % sulfur. The method of producing this steel sheet includes hot rolling and continuous annealing or galvanization steps. The hot rolling step includes a step of completing finish rolling at a temperature of $(A_{\gamma 3}-50)$° C., meaning $(A_{r3}-50)$° C., or higher, and a step of cooling at an average cooling rate of 20° C. per second (° C./s) or more down to the $M_s$ point (defined by Ikeda et al. as the matrix phase of tempered martensite) or lower, or to the $M_s$ point or higher and the $B_s$ point (defined by Ikeda et al. as the matrix phase of tempered bainite) or lower, followed by coiling. The continuous annealing step includes a step of heating to a temperature of the $A_1$ point or higher and the $A_3$ point or lower, and a step of cooling at an average cooling rate of 3° C./s or more down to the $M_s$ point or lower, and, optionally, a step of further applying averaging at a temperature from 100 to 600° C.

U.S. Pat. No. 6,440,584 to Nagataki et al. is directed to a hot dip galvanized steel sheet, which is produced by rough rolling a steel, finish rolling the rough rolled steel at a temperature of $A_{r3}$ point or more, coiling the finish rolled steel at a temperature of 700° C. or less, and hot dip galvanizing the coiled steel at a pre-plating heating temperature of $A_{c1}$ to $A_{c3}$. A continuous hot dip galvanizing operation is performed by soaking a pickled strip at a temperature of 750 to 850° C., cooling the soaked strip to a temperature range of 600° C. or less at a cooling rate of 1 to 50° C./s, hot dip galvanizing the cooled strip, and cooling the galvanized strip so that the residence time at 400 to 600° C. is within 200 seconds.

U.S. Pat. No. 6,423,426 to Kobayashi et al. relates to a high tensile hot dip zinc coated steel plate having a composition comprising 0.05-0.20 mass % carbon, 0.3-1.8 mass % silicon, 1.0-3.0 mass % manganese, and iron as the balance. The steel is subjected to a primary step of primary heat treatment and subsequent rapid cooling to the martensite transition temperature point or lower, a secondary step of secondary heat treatment and subsequent rapid cooling, and a tertiary step of galvanizing treatment and rapid cooling, so as to obtain 20% or more by volume of tempered martensite in the steel structure.

U.S. Pat. Nos. 4,708,748 (Divisional) and 4,615,749 (Parent), both to Satoh et al., disclose a cold rolled dual phase structure steel sheet, which consists of 0.001-0.008 weight % carbon, not more than 1.0 weight % silicon, 0.05-1.8 weight % manganese, not more than 0.15 weight % phosphorus, 0.01-0.10 weight % aluminum, 0.002-0.050 weight % niobium and 0.0005-0.0050 weight % boron. The steel sheet is manufactured by hot and cold rolling a steel slab with the above chemical composition and continuously annealing the resulting steel sheet in such a manner that the steel sheet is heated and soaked at a temperature from $\alpha \rightarrow \gamma$ transformation point to 1000° C. and then cooled at an average rate of not less than 0.5° C./s but less than 20° C./s in a temperature range of from the soaking temperature to 750° C., and subsequently at an average cooling rate of not less than 20° C./s in a temperature range of from 750° C. to not more than 300° C.

All of the above patents and the above patent publication are related to the manufacture of dual phase steel sheets using a continuous annealing method applied to cold rolled steel sheet. A need is thus still called for to develop a new manufacturing method to produce dual phase steel sheets directly by hot rolling without subsequent cold rolling and annealing to reduce manufacturing processes and corresponding costs. This appears particularly important in North America, where a number of steel manufacturers have no continuous annealing production lines to perform controlled cooling.

The present invention is a hot rolled steel sheet having a dual phase microstructure comprised of a martensite phase less than 35% by volume and a ferrite phase of at least 50% by volume formed in the hot-rolled steel sheet after cooling. As used herein a "hot rolled sheet" and "hot rolled steel sheet" means a steel sheet that has been hot rolled, before cold rolling, heat treatment, work hardening, or transformation by another process. The steel sheet also has a composition comprising carbon in a range from about 0.01% by weight to about 0.2% by weight, manganese in a range from about 0.3% by weight to about 3% weight, silicon in a range from about 0.2% by weight to about 2% by weight, chromium and nickel in combination from about 0.2% by weight to about 2% by weight where chromium if present is in a range from about 0.1% by weight to about 2% by weight and nickel if present is in an amount up to about 1% by weight, aluminum in a range from about 0.01% by weight to about 0.10% by weight and nitrogen less than about 0.02% by weight, where the ratio of Al/N is more than about 2, molybdenum less than 0.2% by weight, and calcium in a range from about 0.0005% by weight to about 0.01% by weight, with the balance of the composition comprising iron and incidental ingredients. Additionally, the steel sheet comprises properties comprising a tensile strength of more than about 500 megapascals and a hole expansion ratio more than about 50% and more particularly may have a tensile strength 590 megapascals and a hole expansion ratio more than about 70%. Alternately, the ratio of Al/N may be more than 2.5, or may be more than about 3.

For hot rolled sheet which is for subsequent processing by cold rolling, alternative steel composition may be provided as above described except the silicon range may be from about 0.05% to about 2%, and the amount of molybdenum may be up to 0.5%.

In various embodiments, the steel composition may have copper in an amount up to about 0.8% by weight, phosphorous in an amount up to about 0.1% by weight, and sulfur in an amount up to about 0.03% by weight. In some embodiments, the composition may additionally include titanium in an amount up to about 0.2% by weight, vanadium in an amount up to about 0.2% by weight, niobium in an amount up to about 0.2% by weight, and boron in an amount up to about 0.008% by weight.

The hot rolled dual phase steel may be made by a method comprising:

(I) hot rolling a steel slab having the above composition into a hot band at a hot rolling termination temperature in a range between about ($A_{r3}$−60)° C. and about 980° C. (about 1796° F.);

(II) cooling the hot band at a mean rate of at least about 5° C./s (about 9° F./s) to a temperature not higher than about 750° C. (about 1382° F.); and (III) coiling the hot band to form a coil at a temperature higher than the martensite formation temperature.

Alternately, the hot rolling termination temperature may be in a range between about ($A_{r3}$−30)° C. and about 950° C. (about 1742° F.).

The steel slab prior to hot rolling may have a thickness between about 25 and 100 millimeters. Alternately, the steel slab may be thicker than 100 millimeters, such as between about 100 millimeters and 300 millimeters, but in such thicker slabs preheating may be needed before hot rolling.

The present dual phase steel has improved weld properties with a more stable microhardness profile between the weld and the heat affected zone adjacent the weld than prior dual phase steels. The microhardness stability of the present dual phase steel provides a difference of less than about 100 HV (500 gf), or alternatively less than 80 HV (500 gf), between the highest hardness on a weld and the lowest hardness on a heat affected zone adjacent the weld, when welded with a conventional gas metal arc welding system such as a metal inert gas (MIG) welding system using 90% argon and 10% carbon dioxide gas.

The hot rolled steel sheet may comprise a dual phase microstructure having a martensite phase between about 3% by volume and about 35% by volume in the hot-rolled steel sheet after cooling, and more particularly from about 10% by volume to about 28% by volume in the hot-rolled steel sheet after cooling. The dual phase microstructure of the steel sheet may have a ferrite phase between about 60% and about 90% by volume or between about 65% and about 85% by volume in the hot-rolled steel sheet after cooling. In addition, the hot-rolled steel sheet may have a yield strength/tensile strength ratio less than about 70%.

The invention is explained in more detail in connection with the accompanying Figures and description set forth below.

BRIEF DESCRIPTION OF THE DRAWINGS

The accompanying drawings assist in describing illustrative embodiments of the present disclosure, in which.

DETAILED DESCRIPTION OF THE DISCLOSURE

Figure 1:
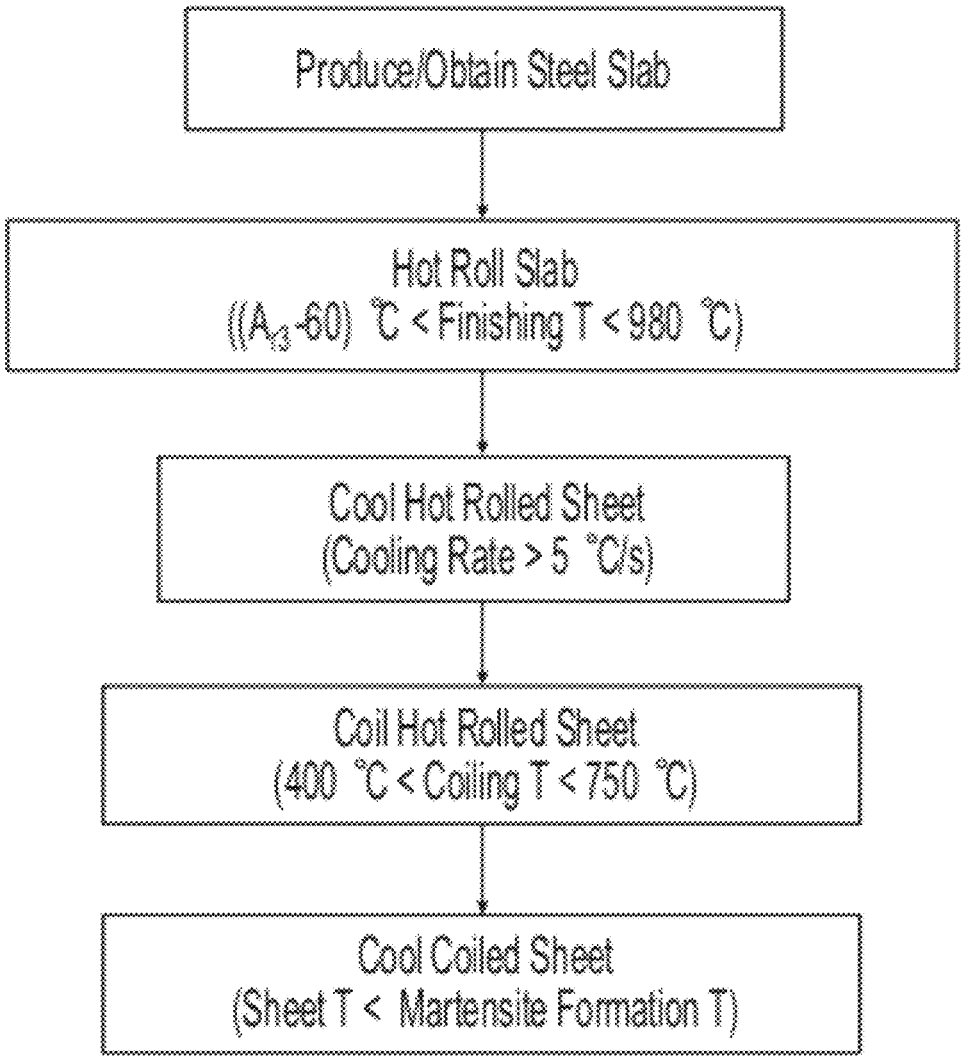
FIG. 1 is a flow chart illustrating an embodiment of the presently disclosed process.

The present disclosure is directed to a hot rolled, low carbon, dual phase steel sheet and a method of making such a steel sheet. The hot rolled steel sheet has a composition comprising carbon in a range from about 0.01% by weight to about 0.2% by weight, manganese in a range from about 0.3% by weight to about 3% weight, silicon in a range from about 0.2% by weight to about 2% by weight, chromium and nickel in combination from about 0.2% by weight to about 2% by weight where chromium if present is in a range from about 0.1% by weight to about 2% by weight and nickel if present is in an amount up to about 1% by weight, aluminum in a range from about 0.01% by weight to about 0.10% by weight and nitrogen less than about 0.02% by weight, where the ratio of Al/N is more than about 2, molybdenum less than 0.2% by weight, and calcium in a range from about 0.0005% by weight to about 0.01% by weight, with the balance of the composition comprising iron and incidental ingredients.

For hot rolled sheet which is for subsequent processing by cold rolling, an alternative steel composition may be provided as herein described except the silicon range may be from about 0.05% to about 2%, and the amount of molybdenum may be up to 0.5%.

In various embodiments, the steel composition may have copper in an amount up to about 0.8% by weight, phosphorous in an amount up to about 0.1% by weight, and sulfur in an amount up to about 0.03% by weight. In some embodiments, as described in more detail below, the composition may additionally include titanium in an amount up to about 0.2% by weight, vanadium in an amount up to about 0.2% by weight, niobium in an amount up to about 0.2% by weight, boron in an amount up to about 0.008% by weight.

The hot rolled steel sheet exhibits high tensile strength and excellent formability, in that the steel sheet has a tensile strength of more than about 500 megapascals (MPa) and a hole expansion ratio of at least 50%, and more particularly a tensile strength of more than about 590 MPa and a hole expansion ratio of at least 70%. The yield strength/tensile strength ratio is less than about 70%. Alternately, the steel sheet has a tensile strength of more than about 780 MPa, and a hole expansion ratio of at least 50%. The steel sheet as hot-rolled according to the present disclosure possesses a microstructure comprising up to about 35% by volume martensite islands dispersed in a ferrite matrix phase of more than 50% by volume formed in the as-hot-rolled steel sheet after cooling. Alternatively, the microstructure of the steel sheet may have about 3% to about 30% by volume martensite islands embedded in a ferrite matrix phase formed in the as-hot-rolled sheet.

The ferrite matrix phase is the continuous phase in which the martensite phase of up to about 35% is dispersed after cooling. The ferrite matrix phase may be less than 90% by volume and is formed in the as-hot-rolled sheet after cooling. Alternately or in addition, the ferrite matrix phase is between about 60% and about 90% by volume, and may be more than 65% of the microstructure by volume in the as-hot-rolled sheet after cooling.

The steel sheet of the present disclosure can be used after being formed (or otherwise press formed) in an "as-hot-rolled" state, or optionally can be coated with zinc and/or zinc alloy, for instance, for automobiles, electrical appliances, building components, machineries, and other applications.

As described in more detail below, the presently disclosed dual phase steel sheet has improved properties of high tensile strength, low yield strength/tensile strength ratio, excellent weldability (microhardness stability across welds) and excellent formability (hole expansion ratio, stretch flangeability) formed directly by hot rolling. The ranges for the content of various ingredients such as carbon in the composition of the resultant steel sheet, and reasons for the ranges of ingredients in the present steel composition, are described below.

Carbon in the present steel composition provides hardenability and strength to the steel sheet. Carbon is present in an amount of at least about 0.01% by weight in order to enable the desired martensite and ferrite phases and strength properties to the steel sheet. In order to enable the formation of martensite contributing to the improvement of the strength properties, carbon may be about 0.02% by weight. Since a large amount of carbon in the present steel composition has been found to markedly deteriorate the formability and weldability of the steel sheet, the upper limit of the carbon content is about 0.2% by weight for an integrated hot mill. Alternatively, the carbon content in the present steel may be no more than about 0.12% by weight for steel sheet made by hot mills at compact strip production (CSP) plants to provide excellent castability of the steel sheet. Alternatively, carbon may be present in a range from about 0.03% by weight to about 0.1% by weight in the present steel.

Manganese of between about 0.3% and 3% by weight in the present steel composition is another alloy enhancing the strength of steel sheet. An amount of at least about 0.3% by weight of manganese has been found in order to provide the strength and hardenability of the steel sheet. Alternatively, in order to enhance the stability of austenite in the present steel composition and at least about 3% by volume of a martensite phase in the steel sheet, the amount of manganese in the present steel composition should be more than about 0.5% by weight. On the other hand, when the amount of manganese exceeds about 3% by weight, it has been found that the weldability of the steel sheet of the present steel composition is adversely affected. Alternatively, the amount of manganese may be less than about 2.5% by weight or between about 0.5% and about 2.5% by weight in the present steel.

Silicon in the range of about 0.2% and about 2% in the present steel composition has been found to provide the desired strength, and not significantly impairing the desired ductility or formability of the steel sheet. Silicon in this range also has been found in the present steel composition to promote the ferrite transformation and delay the pearlite transformation. As pearlite is not desired in the ferrite matrix of the steel sheet, the present composition has silicon in an amount in the range of about 0.2% and about 2% by weight. When the content of silicon exceeds about 2% by weight in the present steel, it has been found that the beneficial effect of silicon is saturated and accordingly, the upper limit of silicon content is about 2% by weight. Alternatively, silicon may be present in a range from about 0.2% by weight to about 1.5% by weight in the present steel. For hot rolled steel sheet which is for subsequent processing by cold rolling, the silicon range may be from about 0.05% to about 2%.

Chromium and nickel in combination in an amount between about 0.2% by weight and about 2% by weight in the present steel composition has been found effective for improving the hardenability and strength of the steel sheet. Chromium and nickel in such amounts has also been found useful in the present steel for stabilizing the remaining austenite and to promote the formation of martensite while having minimal or no adverse effects on austenite to ferrite transformation. These properties have been provided in the present steel by a combination of chromium and nickel from about 0.2% by weight to about 2% by weight, where chromium if present is in an amount between about 0.1% and about 2% by weight and nickel if present in an amount up to about 1% by weight. Alternatively, the combination of chromium and nickel may be present in a range from about 0.2% by weight to about 1.5% by weight, or from about 0.3% by weight to about 1.5% by weight in the present steel.

Aluminum is present in the present steel composition to deoxidize the steel composition and react with nitrogen, if any, to form aluminum nitrides. Theoretically, the acid-soluble amount of (27/14) N, i.e., 1.9 times the amount of nitrogen, is required to fix nitrogen as aluminum nitrides. Practically, however, it has found that the ratio of Al/N needed in the present steel composition is above about 2, and in some cases above 2.5. Alternately, the ratio of Al/N may be above about 3, and in some cases above 3.5. At least 0.01% by weight of aluminum is effective as a deoxidation element in the present steel composition. When the content of aluminum exceeds about 0.1% in the present steel, on the other hand, the ductility and formability of the steel sheet has been found to significantly degrade. Hence, the amount of aluminum in the present steel is between about 0.01% and about 0.1% by weight. Alternatively, aluminum may be present in a range between about 0.015% and about 0.09% by weight, or in the range between about 0.02% and about 0.08% by weight in the present steel.

Calcium is used in the present steel composition is to assist the shape of sulfides, if any. Calcium assists in reducing the harmful effect due to sulfur, if any, and improve the stretch flangeability and fatigue property of the present steel sheet. At least about 0.0005% by weight of calcium has been found to be needed in the present steel composition to provide these beneficial properties. On the other hand, this beneficial effect has been found to be saturated when the amount of calcium exceeds about 0.01% by weight in the present steel composition, so that is the upper limit specified for calcium. Alternatively, calcium may be present in a range from about 0.0008% by weight to about 0.009% by weight, or, from about 0.001% by weight to about 0.008% by weight in the present steel.

Phosphorus is generally present as a residual ingredient in iron sources used in steelmaking. In principle, phosphorus in the present steel composition exerts an effect similar to that of manganese and silicon in view of solid solution hardening. In addition, when a large amount of phosphorus is added to the present steel composition, the castability and rollability of the steel sheet has been found to deteriorate. Also, the segregation of phosphorus at grain boundaries of the present composition has been found to result in brittleness of the steel sheet, which in turn impairs its formability and weldability. For these reasons, the upper limit of phosphorus content in the present steel composition is about 0.1% by weight. Alternatively, the upper limit of phosphorus may be about 0.08% by weight, or about 0.06% by weight in the present steel.

Sulfur is not usually added to the present steel composition because as low as possible sulfur content is desired. A residual amount of sulfur may be present depending on the steel making technique that is employed in making the present steel composition. However, the present steel composition contains manganese, so that residual sulfur if present typically is precipitated in the form of manganese sulfides. On the other hand, since a large amount of manganese sulfide precipitate greatly deteriorates the formability and fatigue properties of the present steel sheet, the upper limit of sulfur content is about 0.03% by weight. Alternatively, the upper limit of sulfur may be about 0.02% by weight, or about 0.01% by weight in the present steel.

When nitrogen exceeds about 0.02% by weight in the present steel composition, it has been found that the ductility and formability of the steel sheet are significantly reduced. Accordingly, the upper limit of nitrogen content is about 0.02% by weight in the present steel composition. Alternatively, the upper limit of nitrogen may be about 0.015% by weight, or about 0.01% by weight in the present steel.

Boron, even in a small amount, is very effective for improving the hardenability and strength of the steel sheet in the present steel composition. However, when boron is added in excess, the rollability of the present steel sheet is found to be significantly lowered. Also with excess amounts of boron, the segregation of boron at grain boundaries deteriorates the formability. For these reasons, the upper limit of boron content in the present steel composition is about 0.008% by weight. Alternatively, the upper limit of boron may be about 0.006% by weight, or about 0.005% by weight in the present steel. It is also possible that no boron is present in the present steel sheet.

Molybdenum in the present steel composition is effective for improving the hardenability and strength of the steel sheet. However, excess addition of molybdenum results in a saturated effect and promotes the formation of an undesired bainite phase. Furthermore, molybdenum is expensive. The upper limit for molybdenum in the present steel composition is about 0.2% by weight in the present steel. For hot rolled steel sheet which is for subsequent processing by cold rolling, the upper limit of molybdenum may be about 0.5%, or alternately may be about 0.3%.

Copper may be present as a residual ingredient in iron sources, such as scrap, used in steelmaking. Copper as an alloy in the present steel composition is also effective for improving the hardenability and strength of the steel sheet. However, excess addition of copper in the steel composition has been found to significantly deteriorate the surface quality of the steel sheet. Copper is also expensive. The upper limit for copper in the steel composition is about 0.8% by weight. Alternatively, the upper limit for copper may be about 0.6% by weight, or about 0.4% by weight in the present steel.

In the present steel composition, titanium, vanadium, and/or niobium may also be used as an alloy and have a strong effect on retarding austenite recrystallization and refining grains. Titanium, vanadium, or niobium may be used alone or in any combination in the steel composition. When a moderate amount of one or more of them is added, the strength of the steel sheet is markedly increased. These elements are also useful in the present steel composition to accelerate the transformation of austenite phase to ferrite phase in the steel microstructure. However, when each of these elements alone or in combination exceeds about 0.2% by weight, an unacceptable large amount of the respective precipitates is formed in the present steel sheet. The corresponding precipitation hardening becomes very high, reducing castability and rollability during manufacturing the steel sheet, and also unacceptably deteriorating the formability of the present steel sheet when forming or press forming the produced steel sheet into final parts. Accordingly, the present steel composition has no more than about 0.2% by weight of titanium, vanadium, and/or niobium. Alternatively, the upper limit of each of titanium, vanadium, and/or niobium may be about 0.15% by weight in the present steel.

Incidental ingredients and other impurities should be kept to as small a concentration as is practicable with available iron sources and additives with available purity used in steelmaking. Incidental ingredients are typically the ingredients arising from use of scrap metals and other additions in steelmaking, as occurs in preparation of molten composition in a steelmaking furnace such as an electric arc furnace (EAF).

The presently disclosed process to produce a dual phase steel composition requires a less demanding and restrictive facility and processing steel with described properties. By the present process, dual phase steel composition of less than 35% by volume martensite phase in a continuous ferrite phase of more than 50% by volume can be made directly by hot rolling and cooling. As a result, the disclosed process can be carried out at most existing compact strip or CSP mills or carried out at most existing integrated mills.

An embodiment of the disclosed process comprises the following steps:

i. Obtain or produce as a starting material a thin steel slab having a composition within the ranges disclosed above, and having a thickness suitable for hot rolling into a hot rolled band. Hot rolled band is also referred to as a hot rolled steel sheet. A thin slab can be produced from a molten steel having a composition within the ranges disclosed above by using, for instance, a continuous slab caster or an ingot caster.

ii. Hot roll the steel slab into a hot band and complete the hot rolling process at a termination or finishing temperature in a range between about ($A_{r3}$−60)° C. and about 980° C. (1796° F.), in order to obtain a fine-grained ferrite matrix capable of producing an as-hot-rolled sheet with a microstructure of more than 50% ferrite phase by volume with a martensite phase of less than 35% dispersed therein. The total reduction used during hot rolling is more than 50%, or may be more than 75%.

iii. Cool the hot rolled steel, after completing hot rolling, at a mean rate not slower than about 5° C./s (9° F./s) to a temperature not higher than about 750° C. (about 1382° F.).

iv. Coil the hot rolled steel by a coiler, when the hot band has cooled to a temperature higher than about 400° C. (752° F.) and not higher than about 750° C. (1382° F.). A conventional coiler may be used. Then, cool the coiled sheet to a temperature lower than about the martensite formation temperature, or the martensite start temperature, to form martensite islands of less than 35% by volume embedded in a ferrite matrix phase. The ferrite phase is thus more than 50% by volume and may be more than 60% or 65% by volume in the as-hot-rolled sheet after cooling.

v. If desired, applying a coating, such as a zinc coating and/or a zinc alloy coating, to the steel sheet may be effected. The coating should improve the corrosion resistance of the steel sheet. Further, the "as-hot-rolled" sheet or coated sheet may be formed or press formed into a desired end shape for a final application.

After hot rolling, the coiling step may occur at a temperature above the martensite formation temperature, or the martensite start temperature. The martensite formation temperature is the temperature at which martensite begins to form when cooling. The martensite formation temperature may vary with the steel composition, but may be between about 300° C. and about 450° C.

After coiling the hot-rolled steel sheet, the coil then cools to below the martensite formation temperature, obtaining a dual phase microstructure having a martensite phase up to about 35% by volume in a ferrite matrix phase of more than 50% by volume in the as-hot-rolled sheet. The martensite phase may be between about 3% and 30% by volume in the ferrite matrix phase in the as-hot-rolled sheet. Alternately or in addition, the martensite phase may be between about 8% and about 30% by volume in the ferrite matrix phase in the as-hot-rolled sheet, and may be between about 10% and about 28% by volume in the ferrite matrix phase.

The ferrite phase is more than 50% by volume and may be less than 90%. Alternately or in addition, the ferrite phase is more than 60% and less than 90% by volume in the as-hot-rolled sheet, or may be more than 65% and less than 85% by volume in the as-hot-rolled sheet after cooling. While the ferrite phase may contain neither precipitates nor inclusions and no other microstructure phases present in the steel sheet, in practice it is difficult to obtain a strictly dual phase material. Although not desired, there may be a small amount of residual or incidental other phases in the steel sheet, such as pearlite and/or bainite. The sum of residual or incidental phases may be less than 15% by volume, and usually less than 8% by volume.

The present process is for producing a dual phase steel sheet having high tensile strength and excellent formability by a hot rolling process as follows:

i. Produce or obtain as a starting material a thin steel slab, typically with a thickness ranging from about 25 to about 100 millimeters, for instance using a CSP facility, to form a steel composition including (in weight percentages) about 0.01% to about 0.2% carbon (C), about 0.3% to about 3% manganese (Mn), about 0.2% to about 2% silicon (Si), a combination of chromium (Cr) and nickel (Ni) between about 0.2% and 2% by weight with about 0.1% to about 2% by weight chromium (Cr) and up to 1% by weight nickel (Ni), not more than about 0.1% phosphorous (P), not more than about 0.03% sulfur (S), not more than about 0.02% nitrogen (N), about 0.01 to about 0.1% aluminum (Al), where the ratio of Al/N is more than about 2, not more than about 0.2% titanium (Ti), not more than about 0.2% vanadium (V), not more than about 0.2% niobium (Nb), not more than about 0.008% boron (B), not more than about 0.2% molybdenum (Mo), not more than about 0.8% copper (Cu), and about 0.0005% to about 0.01% calcium (Ca), the remainder essentially being iron (Fe) and raw material impurities.

ii. Hot roll the steel slab to form a hot rolled band and complete the hot rolling process at a termination or finishing temperature in a range between about ($A_{r3}$−30)° C. and about 950° C. (1742° F.). The total reduction used during hot rolling is more than 50%, and may be more than 75%.

iii. Cool the hot rolled steel sheet immediately after completing hot rolling at a mean cooling rate not slower than about 10° C./s (18° F./s) to a temperature not higher than about 650° C. (about 1202° F.).

iv. Coil the hot rolled steel on a coiler, starting the coiling process when the hot band has cooled to a temperature above the martensite formation temperature. The coiling temperature may be higher than about 450° C. (842° F.) and lower than about 650° C. (1202° F.). Starting the coiling when the hot band has cooled to a temperature not higher than about 650° C. (1202° F.) may result in better formability and drawability properties. When cooled, the coiled sheet is at a temperature lower than the martensite formation temperature to form martensite islands dispersed in a ferrite matrix phase, where the martensite is between about 3% and 30% by volume.

v. Further, hot dip plating or electroplating may be performed to apply a zinc coating and/or a zinc alloy coating onto the surface of the above hot rolled steel sheet to improve the corrosion resistance. Either the "as-hot-rolled" sheet or coated sheet may be formed or press formed into the desired end shapes for any final applications.

In the disclosed process, a starting material steel slab thicker than about 100 millimeters (mm) may be employed, For instance, the steel slab thickness may be about 150 millimeters or thicker, or about 200 millimeters or yet thicker, or, about 300 millimeters and thicker. Such a steel slab employed as a starting material, with the above-noted chemical composition, can be produced in an integrated hot mill by continuous casting or by ingot casting. For a thicker slab produced in an integrated mill, a reheating process may be required before conducting the above-mentioned hot rolling operation, by reheating the steel slab to a temperature in a range between about 1050° C. (1922° F.) and about 1350° C. (2462° F.) and more typically between about 1100° C. (2012° F.) and about 1300° C. (2372° F.), and then holding at this temperature for a time period of not less than about 10 minutes and more typically not less than about 30 minutes. The reheating helps to assure the uniformity of the initial microstructure of the slabs before conducting the hot rolling process of the present disclosure. On the other hand, for a thin slab (under about 100 mm) cast as occurs in a CSP plant, the reheating process is usually not needed unless the slab is cooled. FIG. 1 is a process flow diagram which illustrates the above-described steps of the presently disclosed process.

Several types of low carbon molten steels were made using an electric arc furnace, and were then formed into thin slabs with a thickness of about 53 millimeters at the Nucor-Berkeley compact strip production plant. The samples tested are shown in TABLE 1 having compositions according to the present disclosure and manufactured according to the presently disclosed process. As shown in TABLE 2, the measured fraction of martensite phase ranged from 11% to 28% by volume for the steel samples having compositions according to the present disclosure and manufactured according to the present process.

The following were specific process conditions recorded for steel samples of the composition and process of the present disclosure. A steel slab for each of presently disclosed steels (Samples A, B, C, E, F, I, J, and K) was hot rolled to form hot bands using hot rolling termination temperatures (also called finishing or exit temperatures) ranging from 870° C. (1598° F.) to 930° C. (1706° F.). The total reduction used during hot rolling was more than 85% to obtain the thickness of the hot rolled steel sheets ranging from 2.5 millimeters to 5.9 millimeters, as shown in TABLE 2. Immediately after hot rolling, the hot rolled steel sheets were water cooled on a conventional run-out table at a mean rate of at least about 5° C./s (about 9° F./s), and coiled at coiling temperatures ranging from 500° C. (932° F.) to 650° C. (1202° F.). The compositions of these various steel compositions are presented below in TABLE 1.

Test pieces were taken from the resulting hot rolled steel sheets, and were machined into tensile specimens in the longitudinal direction, namely along the hot rolling direction, for testing of the respective mechanical properties of the various steel sheets.

Tensile testing was conducted in accordance with the standard ASTM A370 method to measure the corresponding mechanical properties, including yield strength, tensile strength, and total elongation. The test data obtained are presented below in TABLE 2.

TABLE 1

| Steel | Remark | Chemical Composition (wt %) | | | | | | | | | | |
|---|---|---|---|---|---|---|---|---|---|---|---|---|
| | | C | Mn | P | S | Si | Al | Ti | Cr + Ni | Nb | Mo | Ca |
| A | Invention | 0.046 | 1.568 | 0.022 | 0.0020 | 0.962 | 0.039 | 0.015 | 0.850 | 0.006 | 0.016 | 0.0032 |
| B | Invention | 0.058 | 1.588 | 0.009 | 0.0005 | 0.915 | 0.046 | 0.015 | 0.855 | 0.007 | 0.016 | 0.0018 |
| C | Invention | 0.039 | 1.632 | 0.024 | 0.0010 | 0.335 | 0.050 | 0.021 | 0.957 | 0.006 | 0.019 | 0.0027 |
| D | Comparison | 0.045 | 1.596 | 0.015 | 0.0020 | 0.200 | 0.042 | 0.010 | 0.829 | 0.006 | 0.128 | 0.0036 |
| E | Invention | 0.045 | 1.591 | 0.008 | 0.0000 | 0.343 | 0.041 | 0.015 | 0.892 | 0.004 | 0.019 | 0.0048 |
| F | Invention | 0.042 | 1.611 | 0.014 | 0.0000 | 0.316 | 0.046 | 0.020 | 0.861 | 0.029 | 0.132 | 0.0031 |
| G | Comparison | 0.060 | 1.576 | 0.012 | 0.0010 | 0.731 | 0.050 | 0.014 | 0.747 | 0.030 | 0.201 | 0.0022 |
| H | Comparison | 0.044 | 1.472 | 0.013 | 0.0001 | 0.177 | 0.060 | 0.011 | 0.735 | 0.006 | 0.125 | 0.0020 |
| I | Invention | 0.056 | 1.610 | 0.011 | 0.0040 | 0.665 | 0.031 | 0.072 | 0.736 | 0.039 | 0.027 | 0.0021 |
| J | Invention | 0.052 | 1.553 | 0.012 | 0.0030 | 0.667 | 0.052 | 0.018 | 0.833 | 0.005 | 0.018 | 0.0033 |
| K | Invention | 0.045 | 1.633 | 0.013 | 0.0001 | 1.058 | 0.046 | 0.012 | 0.896 | 0.002 | 0.008 | 0.0021 |
| L | Comparison | 0.062 | 1.489 | 0.013 | 0.0030 | 0.462 | 0.043 | 0.065 | 0.064 | 0.031 | 0.098 | 0.0023 |
| M | Comparison | 0.044 | 1.550 | 0.008 | 0.0030 | 0.198 | 0.044 | 0.014 | 1.046 | 0.005 | 0.019 | 0.0020 |
| N | Comparison | 0.050 | 0.593 | 0.007 | 0.0020 | 0.169 | 0.038 | 0.011 | 0.554 | 0.002 | 0.014 | 0.0030 |
| O | Commercial-Prior Arts | 0.071 | 1.220 | 0.009 | 0.002 | 0.218 | 0.052 | 0.015 | 0.095 | 0.006 | 0.215 | 0.00 |

TABLE 2

| Steel | Remark | Thickness (mm) | Yield Strength (MPa) | Tensile Strength (MPa) | Total Elongation (%) | Yield/Tensile Ratio (%) | Martensite Fraction (%) |
|---|---|---|---|---|---|---|---|
| A | Invention | 3.8 | 369 | 637 | 27 | 58 | 16 |
| B | Invention | 5.9 | 420 | 694 | 27 | 61 | 21 |
| | | 4.9 | 368 | 637 | 27 | 58 | 17 |
| C | Invention | 5.9 | 399 | 625 | 26 | 64 | 11 |
| | | 4.9 | 418 | 625 | 25 | 67 | 11 |
| D | Comparison | 4.1 | 591 | 717 | 18 | 82 | 50 |
| E | Invention | 3.6 | 416 | 634 | 25 | 66 | 15 |
| | | 2.5 | 431 | 631 | 25 | 68 | 13 |
| F | Invention | 4.1 | 444 | 672 | 23 | 66 | 18 |
| | | 3.1 | 406 | 648 | 26 | 63 | 15 |
| G | Comparison | 4.1 | 578 | 640 | 28 | 90 | 0 |
| | | 3.1 | 684 | 829 | 28 | 83 | 0 |
| H | Comparison | 5.1 | 490 | 623 | 26 | 79 | 5 |
| | | 3.5 | 449 | 569 | 26 | 79 | 3 |
| I | Invention | 3.6 | 533 | 818 | 20 | 65 | 28 |
| J | Invention | 5.9 | 504 | 754 | 25 | 67 | 25 |
| | | 4.0 | 410 | 635 | 26 | 65 | 17 |
| K | Invention | 4.1 | 432 | 614 | 27 | 70 | 16 |
| | | 3.2 | 435 | 660 | 25 | 66 | 18 |
| L | Comparison | 4.0 | 602 | 678 | 25 | 89 | 0 |
| | | 3.0 | 579 | 663 | 24 | 87 | 0 |
| M | Comparison | 3.5 | 538 | 658 | 24 | 82 | 3 |
| N | Comparison | 4.0 | 379 | 466 | 33 | 81 | 0 |
| O | Commercial | 5.9 | 427 | 611 | 25 | 70 | 6 |
| | Prior Arts | 4.1 | 441 | 623 | 24 | 71 | 7 |

Figure 2A:
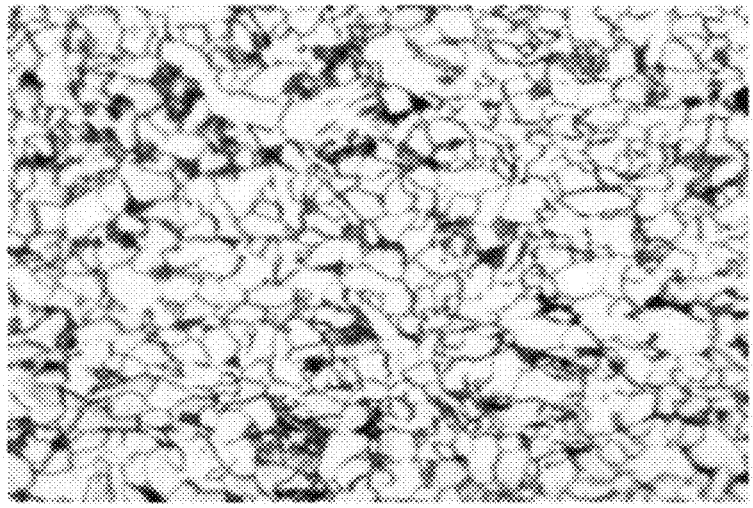
FIG. 2A is a photograph taken through a 500× microscope of one embodiment of the present hot rolled dual phase steel sheet.
Figure 2B:
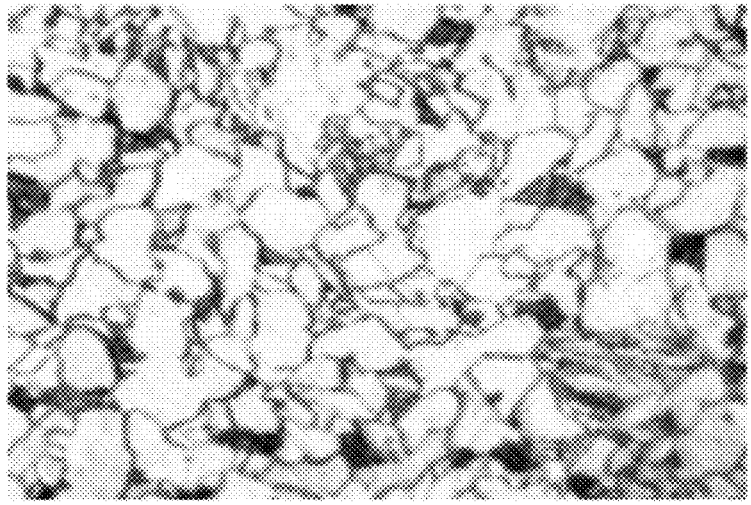
FIG. 2B is a photograph taken through a 1000× microscope of the steel sheet of FIG. 2A.

The microstructure of the present hot-rolled dual phase steel sheets was examined. Typical micrographs obtained using a Nikon Epiphot 200 Microscope are given in FIGS. 2A and 2B, at 500× and 1000× magnification. As illustrated by the micrographs, martensite islands are substantially uniformly distributed in the continuous ferrite matrix. It is such a dual phase structure that provides the excellent combination of strength and formability for the presently disclosed steel sheet.

The hole expansion ratio λ is a measure of stretch flangeability, which may indicate ability of the steel sheet to be formed into complex shapes. To compare the stretch flangeability and stretch formability of the presently disclosed hot rolled steel sheet with comparison commercial hot rolled dual phase steel, square test specimens of about 100 millimeters by 100 millimeters were cut from steel sheets of various thicknesses. The hole expansion ratio λ was determined according to Japan Iron and Steel Federation Standard JFS T1001. The hole expansion ratio is defined as the amount of expansion obtained in a circular punch hole of a test piece when a conical punch is pressed into the hole until any of the cracks that form at the hole edge extend through the test piece thickness. Numerically, the hole expansion ratio is expressed as the ratio of the final hole diameter at fracture through thickness to the original hole diameter, as defined by the following equation:

$$\lambda=((D_h-D_o)/D_o)\times 100$$

where λ=Hole expansion ratio (%), $D_o$=Original hole diameter (Do=10 millimeters), and $D_h$=Hole diameter after fracture (in millimeters). A greater hole expansion ratio may enable the stamping and forming of various complex parts without developing fractures during stamping or forming processes.

TABLE 3

| Steel | Remark | Thickness (millimeters) | Hole Expansion Ratio λ (%) |
|---|---|---|---|
| A | Invention | 3.8 | 81.8 |
| E | Invention | 2.5 | 79.7 |
| K | Invention | 4.1 | 75.8 |
| | | 3.2 | 84.9 |
| O | Commercial-Prior Arts | 4.1 | 36.6 |

The present hot rolled dual phase steel provides improved hole expansion ratio results. The hole expansion ratio λ of the presently disclosed hot rolled dual phase steel is more than 50%, and may be more than 70%. Alternately or in addition, the hole expansion ratio λ of the present dual phase steel may be more than 80%. Samples of steel A, E and K of the present composition and microstructure were compared to prior comparative commercial Steel Sample O in TABLE 3. The values of hole expansion ratio λ measured on Steel Samples A, E, and K are more than 70%, and more particularly more than 75%. By contrast, this value is lower than 40% for comparative commercial Steel Sample O.

One challenge in prior high strength steels is suitable fatigue properties at welds. Weld fatigue properties are affected by differences between the hardness of the weld, the hardness of the unwelded base material, and the hardness of the heat affected zones adjacent the weld. Fatigue properties may be improved in the present steel by improving the stability of the hardness, or reducing the difference in hardness, between the weld, the unwelded material, and the heat affected zones.

Figure 3:
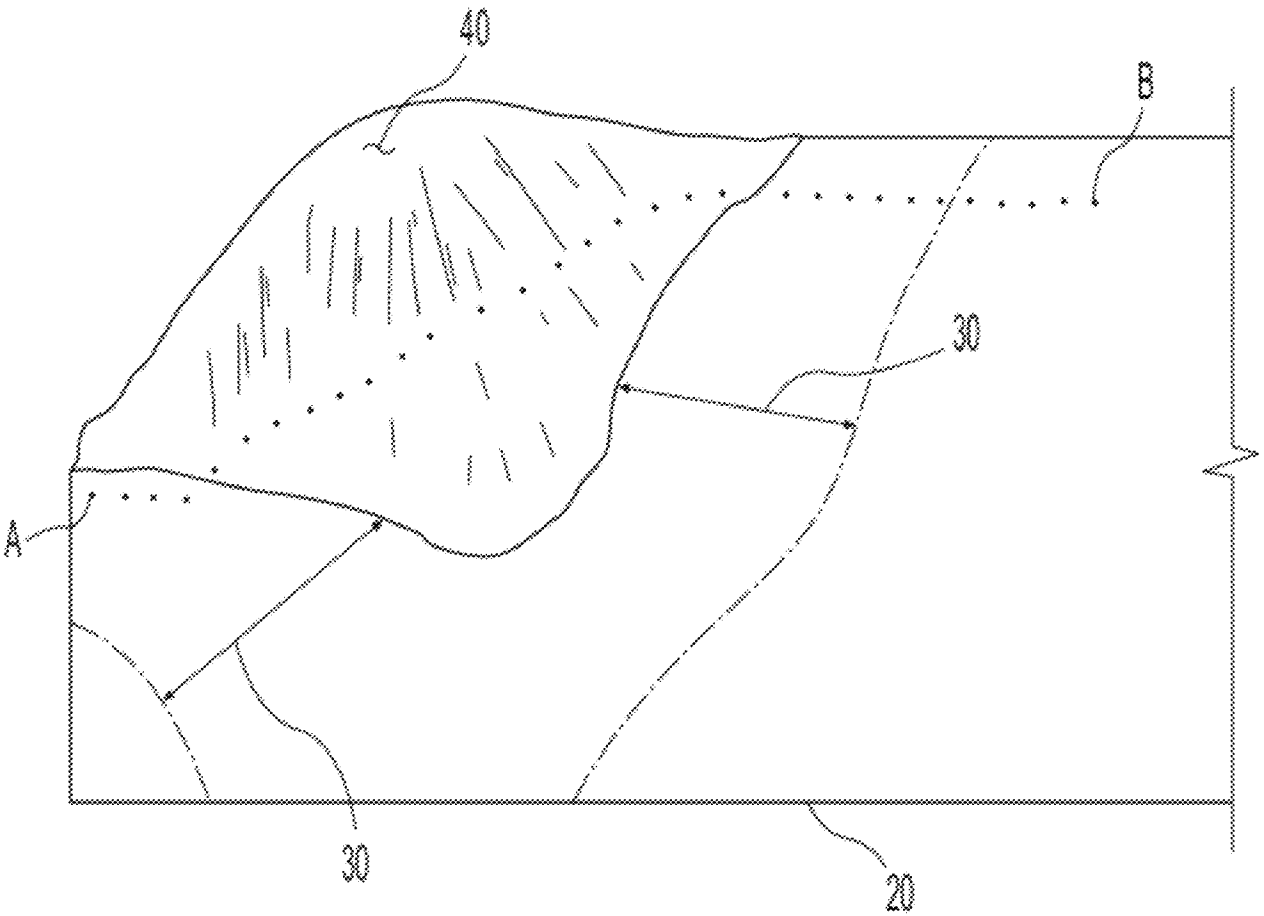
FIG. 3 is a diagrammatical side view of a test specimen showing microhardness measurement points through a weld and heat affected zones adjacent the weld.
Figure 4:
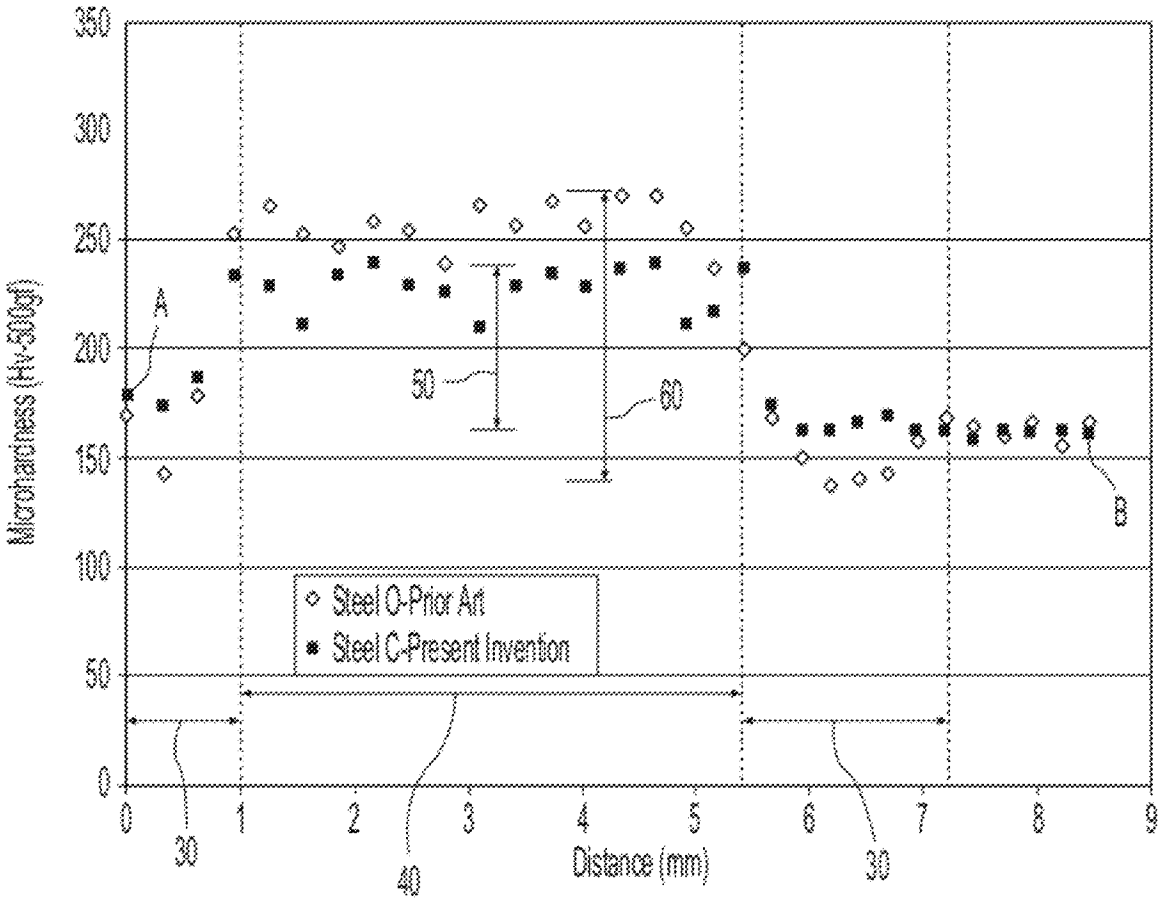
FIG. 4 is a graph showing microhardness across the weld and heat affected zones of the test specimen of FIG. 3.

Weld hardness of the dual phase hot rolled steel is shown in FIGS. 3 and 4. As shown in FIG. 3, the microhardness of gas metal arc-welded test specimens 20 was measured in a plurality of locations from position A to position B. The test specimens 20 were welded using a metal inert gas (MIG) welding process using an OTC Almega-AX-V6 robot and OTC DP400 power source. The filler metal or welding wire was 0.045 inch (1.14 millimeters) ER70S-3 electrode, and the shielding gas was 90% argon and 10% carbon dioxide.

Vickers microhardness measurements were taken on the welded samples through heat affected zones 30 adjacent the weld, and across the weld 40. The hardness near position B is the hardness of the unwelded base material. As shown in the graph of FIG. 4, the comparative commercial Steel Sample O was softened in the heat affected zones where the heat affected zones of the present Steel Sample C were about the same hardness as the unwelded base material.

Additionally, the hardness of the weld was greater in the comparative commercial Steel Sample O than the present Steel Sample C. A microhardness difference 50, 60 is shown in FIG. 4 showing the difference between the microhardness in the weld 40 and the microhardness in the heat affected zone 30 adjacent the weld 40. A large microhardness difference 60 was measured from the weld 40 to the heat affected zone 30 of the comparison Steel Sample O, which may decrease weld fatigue properties in the resulting assembly. As shown in FIG. 4, the weld properties of the present hot rolled dual phase steel comprise a microhardness difference 50 between the weld 40 and the heat affected zone 30 adjacent the weld less than about 100 HV (500 gf). Alternately or in addition, the weld properties comprise a microhardness difference less than about 80 HV (500 gf), and may be less than 70 HV (500 gf). The more stable microhardness profile through the weld, heat affected zone and unwelded base metal obtained with the presently disclosed hot rolled steel improves the weld fatigue performance of the steel.

The hot rolled dual phase steels manufactured by the present process has improved impact toughness and crashworthiness over prior dual phase steels.

In order to evaluate the impact toughness and crashworthiness of the present hot rolled dual phase steel sheets compared to comparison hot rolled dual phase steel sheets, a number of V-notch Charpy impact test specimens having a thickness of about 5 millimeters were machined and prepared according to ASTM E23-05. These specimens were then tested for the material property of mean impact energy at ambient temperature using an Instron Corporation S1-1 K3 Pendulum Impact Machine. During testing, a 407 J (300 ft-lb) Charpy pendulum with a length of 800 millimeters was used at an impact velocity of 5.18 m/s (17 ft/s).

Compared to the prior art hot rolled dual phase steels, the present hot rolled dual phase steel sheets have notably higher impact toughness and crashworthiness, as evidenced by the present hot rolled dual phase steel sheets having a mean impact energy more than about 10,000 g-m on a V-notch Charpy specimen of about 5 millimeters thickness. More particularly, the present hot rolled dual phase steel sheets have a mean impact energy more than about 12,000 g-m, and even more particularly more than about 13,000 g-m, on a V-notch Charpy specimen of about 5 millimeters thickness. TABLE 4 shows the mean impact energy for samples of the present Steel Sample B compared to Comparison Steel O. Each impact energy measurement was taken on a V-notch Charpy specimen of about 5 millimeters thickness, and the mean impact energy was calculated based on at least 5 measurements of each steel sample.

TABLE 4

| Steel | Remark | Mean Impact Energy |
|---|---|---|
| B | Invention | 13756 g-m (99.5 ft-lb) |
| O | Comparison | 5848 g-m (42.3 ft-lb) |

Although the present invention has been shown and described in detail with regard to exemplary embodiments, it should be understood by those skilled in the art that it is not intended to limit the invention to specific embodiments disclosed. Various modifications, omissions, and additions may be made to the disclosed embodiments without materially departing from the novel teachings and advantages of the invention, particularly in light of the foregoing teachings. Accordingly, it is intended to cover all such modifications, omissions, additions, and equivalents as may be included within the spirit and scope of the invention as defined by the following claims.

What is claimed is:

1. A method of making a hot rolled dual phase steel sheet, comprising:

(I) hot rolling a steel slab into a hot band at a hot rolling termination temperature in a range between about ($A_{r3}$−60)° C. and about 980° C. (about 1796° F.), where the steel slab comprises a composition comprising:

carbon in a range from about 0.01% by weight to about 0.2% by weight, manganese in a range from about 0.3% by weight to about 3% weight, silicon in a range from about 0.2% by weight to about 2% by weight, chromium and nickel in combination from about 0.2% by weight to about 2% by weight where the chromium if present is in a range from about 0.1% by weight to about 2% by weight and nickel if present is in an amount up to about 1% by weight, aluminum in a range from about 0.01% by weight to about 0.10% by weight and nitrogen less than about 0.02% by weight, where the ratio of Al/N is more than about 2, molybdenum less than 0.2% by weight, copper less than about 0.4% by weight, and calcium in a range from about 0.0005% by weight to about 0.01% by weight, with the balance of said composition comprising iron and incidental ingredients;

(II) cooling the hot band after completion of hot rolling at a mean rate of at least about 5° C./s (about 9° F./s) to a coiling temperature not higher than about 750° C. (about 1382° F.); and (III) coiling the hot band to form a coil at a temperature more than the martensite formation temperature obtaining a steel sheet comprising (a) a dual phase microstructure comprising a martensite phase of 11-28% by volume and a ferrite phase, (b) said composition, and (c) properties comprising a tensile strength of at least about 590 megapascals and a hole expansion ratio more than about 70%.

2. The method of claim 1, where the properties comprise a tensile strength between about 590 MPa to about 818 MPa, and a hole expansion ratio between more than about 70% to about 85%.

3. The method of claim 1, where the properties further comprise a yield-to-tensile ratio of between 58 and 70.

4. The method of claim 1, where the properties further comprise a total elongation between 20 to 27%.

5. The method of claim 1, where the composition further comprises one or more of:

titanium in an amount up to about 0.2% by weight; vanadium in an amount up to about 0.2% by weight; niobium in an amount up to about 0.2% by weight; boron in an amount up to about 0.008% by weight; copper in an amount up to about 0.8% by weight; phosphorous in an amount up to about 0.1% by weight; and sulfur in an amount up to about 0.03% by weight.

6. The method of claim 1, where the carbon ranges from about 0.02% to about 0.12% by weight, the manganese ranges from about 0.5% to about 2.5% by weight, the silicon ranges from about 0.2% to about 1.5% by weight, the chromium and nickel in combination ranges from about 0.2% to about 1.5% by weight, the aluminum ranges from about 0.015% to about 0.09% by weight, the calcium ranges from about 0.0008% to about 0.009% by percent.

7. The method of claim 1, where the carbon ranges from about 0.03% to about 0.1% by weight, the chromium, nickel in combination ranges from about 0.3% to about 1.5% by weight, the aluminum ranges from about 0.02% to about 0.08% by weight, the calcium ranges from about 0.001% to about 0.008% by percent.

8. The method of claim 1, where the hot rolling termination temperature is in a range between about $(A_{r3}-30)$° C. and about 950° C. (about 1742° F.).

9. The method of claim 1, where cooling the hot band is at a mean rate of at least about 10° C./s (about 18° F./s) to a temperature not higher than about 650° C. (about 1202° F.).

10. The method of claim 1, further comprising pickling the coil.

11. The method of claim 1, where the total reduction during hot rolling is more than about 50%.

12. The method of claim 1, where the total reduction during hot rolling is more than about 75%.

13. The method of claim 1, further comprising:

applying a coating of one or both of a zinc coating or a zinc alloy coating to the hot rolled steel sheet.

14. The method of claim 1, where weld properties comprise a microhardness difference less than about 100 HV (500 gf) between the highest hardness on a weld and the lowest hardness on a heat affected zone adjacent the weld.

15. The method of claim 1, where weld properties comprise a microhardness difference less than about 80 HV (500 gf) between the highest hardness on a weld and the lowest hardness on a heat affected zone adjacent the weld.

16. The method of claim 1, where properties comprise a mean impact energy more than about 10,000 g-m on a V-notch Charpy specimen of about 5 millimeters thickness.

17. The method of claim 1, where properties comprise a yield strength/tensile strength ratio less than about 70%.

18. A method of making a hot rolled dual phase steel sheet, comprising:

(I) hot rolling a steel slab into a hot band at a hot rolling termination temperature in a range between about $(A_{r3}-60)$° C. and about 980° C. (about 1796° F.), where the steel slab comprises a composition comprising:

carbon in a range from about 0.01% by weight to about 0.2% by weight, manganese in a range from about 0.3% by weight to about 3% weight, silicon in a range from about 0.05% by weight to about 2% by weight, chromium and nickel in combination from about 0.2% by weight to about 2% by weight where the chromium if present is in a range from about 0.1% by weight to about 2% by weight and nickel if present is in an amount up to about 1% by weight, aluminum in a range from about 0.01% by weight to about 0.10% by weight and nitrogen less than about 0.02% by weight, where the ratio of Al/N is more than about 2, molybdenum less than 0.5% by weight, copper less than about 0.4% by weight, and calcium in a range from about 0.0005% by weight to about 0.01% by weight, with the balance of said composition comprising iron and incidental ingredients;

(II) cooling the hot band after completion of hot rolling at a mean rate of at least about 5° C./s (about 9° F./s) to a coiling temperature not higher than about 750° C. (about 1382° F.); and (III) coiling the hot band to form a coil at a temperature more than the martensite formation temperature obtaining a steel sheet comprising (a) a dual phase microstructure comprising a martensite phase of 11-28% by volume and a ferrite phase, (b) said composition, and (c) properties comprising a tensile a tensile strength of at least about 590 megapascals and a hole expansion ratio more than about 70%.

19. The method of claim 18, where the properties comprise a tensile strength of between about 590 MPa to about 818 MPa, and a hole expansion ratio between more than about 70% to about 85%.

20. The method of claim 18, where the the properties further comprise a yield-to-tensile ratio of between 58 to 70.

21. The method of claim 18, where the properties further comprise a total elongation between 20 to 27%.

22. The method of claim 18, where the composition further comprises one or more of:

titanium in an amount up to about 0.2% by weight; vanadium in an amount up to about 0.2% by weight; niobium in an amount up to about 0.2% by weight; boron in an amount up to about 0.008% by weight; copper in an amount up to about 0.8% by weight; phosphorous in an amount up to about 0.1% by weight; and sulfur in an amount up to about 0.03% by weight.

23. The method of claim 18, where the carbon ranges from about 0.02% to about 0.12% by weight, the manganese ranges from about 0.5% to about 2.5% by weight, the silicon ranges from about 0.2% to about 1.5% by weight, the chromium and nickel in combination ranges from about 0.2% to about 1.5% by weight, the aluminum ranges from about 0.015% to about 0.09% by weight, the calcium ranges from about 0.0008% to about 0.009% by percent.

24. The method of claim 18, where the carbon ranges from about 0.03% to about 0.1% by weight, the chromium, nickel in combination ranges from about 0.3% to about 1.5% by weight, the aluminum ranges from about 0.02% to about 0.08% by weight, the calcium ranges from about 0.001% to about 0.008% by percent.

25. The method of claim 18, where the hot rolling termination temperature is in a range between about ($A_{r3}$−30)° C. and about 950° C. (about 1742° F.).

26. The method of claim 18, where cooling the hot band is at a mean rate of at least about 10° C./s (about 18° F./s) to a temperature not higher than about 650° C. (about 1202° F.).

27. The method of claim 18, further comprising pickling the coil.

28. The method of claim 18, where the total reduction during hot rolling is more than about 50%.

29. The method of claim 18, where the total reduction during hot rolling is more than about 75%.

30. The method of claim 18, further comprising:

applying a coating of one or both of a zinc coating or a zinc alloy coating to the hot rolled steel sheet.

31. The method of claim 18, where weld properties comprise a microhardness difference less than about 100 HV (500 gf) between the highest hardness on a weld and the lowest hardness on a heat affected zone adjacent the weld.

32. The method of claim 18, where weld properties comprise a microhardness difference less than about 80 HV (500 gf) between the highest hardness on a weld and the lowest hardness on a heat affected zone adjacent the weld.

33. The method of claim 18, where properties comprise a mean impact energy more than about 10,000 g-m on a V-notch Charpy specimen of about 5 millimeters thickness.

34. The method of claim 18, where properties comprise a yield strength/tensile strength ratio less than about 70%.

* * * * *